US009919229B1

(12) United States Patent
Bagumyan et al.

(10) Patent No.: US 9,919,229 B1
(45) Date of Patent: Mar. 20, 2018

(54) INFLATABLE LANDING PAD FOR USE WITH AN INFLATABLE PLAY STRUCTURE

(71) Applicants: Sarmen Bagumyan, Glendale, CA (US); Arthur Bagumyan, Glendale, CA (US); Andranik Andy Bagumyan, Glendale, CA (US)

(72) Inventors: Sarmen Bagumyan, Glendale, CA (US); Arthur Bagumyan, Glendale, CA (US); Andranik Andy Bagumyan, Glendale, CA (US)

( * ) Notice: Subject to any disclaimer, the term of this patent is extended or adjusted under 35 U.S.C. 154(b) by 0 days.

(21) Appl. No.: 15/591,721

(22) Filed: May 10, 2017

(51) Int. Cl.
*A63G 31/12* (2006.01)
*A63G 33/00* (2006.01)
*A63H 33/00* (2006.01)

(52) U.S. Cl.
CPC ..... *A63G 31/12* (2013.01); *A63H 33/008* (2013.01)

(58) Field of Classification Search
CPC ..... A62B 1/22; A63G 31/12; A63H 33/008
USPC ..... 52/2.17; 5/706, 712; 182/137; 472/134; 285/19, 219, 260
See application file for complete search history.

(56) References Cited

U.S. PATENT DOCUMENTS 2,366,067 A * 12/1944 Smith ..... F16L 15/006 222/567
2,390,955 A * 12/1945 McDonnell ..... A62B 1/22 182/137
2,445,358 A * 7/1948 Maechtlen ..... F16L 41/10 285/149.1
3,310,818 A 3/1967 Fischer
3,391,414 A 7/1968 Gordon
3,399,407 A * 9/1968 Olsen ..... A63B 6/02 182/139
3,778,851 A * 12/1973 Howorth ..... A61G 7/057 297/180.13
3,840,922 A * 10/1974 Morrison ..... A63B 6/02 182/137
3,851,730 A * 12/1974 Scurlock ..... A62B 1/22 182/137
3,892,401 A 7/1975 Sorenson
4,068,739 A * 1/1978 Gordon ..... A62B 1/22 182/139
4,289,355 A * 9/1981 Rose ..... B03B 5/26 209/498
4,516,767 A * 5/1985 Eskijian ..... A63B 5/11 482/27
4,896,389 A * 1/1990 Chamberland .... A61G 7/05769 5/710
5,203,427 A * 4/1993 Williams, Sr. ..... A62B 1/20 182/129
5,346,329 A * 9/1994 Goans ..... E02B 15/08 405/60

(Continued)

*Primary Examiner* — Robert Canfield
(74) *Attorney, Agent, or Firm* — Eric Karich; Karich & Associates

(57) ABSTRACT

An inflatable landing pad has an air mattress capable of sustaining an air pressure, and an air supply tube for supplying air from an inflatable play structure to the air mattress. The air mattress is separated into a plurality of sections by vented baffles. A proximal end of the air supply tube is sealably attached to the air mattress around an aperture for directing air into the air mattress, and the distal end of the air supply tube includes a coupling for connecting to an air supply port of the inflatable play structures. The air mattress is adapted to be positioned adjacent an exit portion of an inflatable play structure.

12 Claims, 4 Drawing Sheets

(56) References Cited

U.S. PATENT DOCUMENTS 6,073,291 A * 6/2000 Davis ..... A61B 6/0485 414/676
D439,946 S * 4/2001 Gourchounian ..... D21/835
6,286,876 B1 * 9/2001 Jasperse ..... B64F 1/362 138/156
D595,802 S * 7/2009 Boulton ..... D21/835
8,567,064 B1 * 10/2013 Wright ..... F16L 31/00 285/260
9,278,291 B2 * 3/2016 Scherba ..... A63G 9/00
2005/0046183 A1 * 3/2005 Adams ..... F16L 31/00 285/260
2005/0194058 A1 * 9/2005 Hanchett ..... A63G 31/12 141/7
2006/0211507 A1 * 9/2006 Demirdjian ..... A63G 31/12 472/134
2007/0072690 A1 * 3/2007 Berenson ..... A63G 21/00 472/117
2007/0169273 A1 * 7/2007 Wu ..... A47C 17/045 5/710
2008/0008544 A1 * 1/2008 VanElverginghe . E04H 12/2238 406/28
2008/0011989 A1 * 1/2008 Davis ..... A61G 7/1021 254/93 HP
2009/0211168 A1 * 8/2009 Bogar ..... A63G 31/12 52/2.17
2009/0264042 A1 * 10/2009 Chen ..... A63G 31/007 446/221
2010/0203494 A1 * 8/2010 Scherba ..... A63G 9/00 434/365
2011/0059676 A1 * 3/2011 Scherba ..... A63G 9/00 446/220
2013/0042414 A1 * 2/2013 Schreiber ..... A61G 7/05769 5/714
2015/0051007 A1 * 2/2015 Weekes ..... A63G 31/12 472/134
2016/0101300 A1 * 4/2016 Gray ..... A62B 1/22 182/137
2017/0225070 A1 * 8/2017 Baks ..... A63F 13/28

* cited by examiner

INFLATABLE LANDING PAD FOR USE WITH AN INFLATABLE PLAY STRUCTURE

BACKGROUND OF THE INVENTION

Field of the Invention

This invention relates generally to inflatable landing pads, and more particularly to an inflatable landing pad that is adapted for use with an inflatable play structure for cushioning the fall of a user entering or exiting the inflatable play structure.

Description of Related Art

The prior art teaches a wide range of inflatable bags and similar structures that are used for cushioning the landing of a person or other object. For example, Morrison, U.S. Pat. No. 3,840,922, teaches a landing cushion device for cushioning a person from a great height. The device is inflated with a blower, and includes a first inflatable cushion provided with sidewalls, a supported surface, and a first surface. The supported and first surfaces are opposed, spaced apart and are disposed transversely of the path when the first cushion has been inflated. An inflatable second (upper) cushion body is disposed in advance of the first cushion and has an impact surface and a second surface.

Another form of inflatable bag is shown in Scurlock, U.S. Pat. No. 3,851,730, which teaches an air inflated cushion for absorbing an impact. The Scurlock device is also inflated by a blower, and includes upper and lower sections connected together and also interconnected by air feed holes, the lower one being relatively closed and at a higher pressure, and the upper one including normally closed breathers or quick air release structures and being at a lower pressure.

Another form of cushioning bag is shown in Olsen, U.S. Pat. No. 3,399,407, which teaches a flexible bag having a conduit communicating with the bag and a continuously operating fan unit in the conduit for creating artificial currents of air to maintain the pressure in the bag at a predetermined level. Air expelled from the bag upon impact of a falling object on the bag flows in a reverse direction through the fan unit to avoid pressure build up sufficient to damage the object.

A disadvantage of these inflatable cushioning devices is that they all require blowers, which are more expensive, and require set up, power, etc.

An alternative form of cushioning device is the use of large foam mats which are not inflated, but which cushion via the resilient nature of the foam. These types of foam mats are commonly used to cushion users when entering or exiting a bounce house or similar play structure. While these forms of mats are effective, they are also heavy, cumbersome, and take up significant space.

The prior art teaches inflatable bags that are inflated with blowers, and the prior art also teaches non-inflated foam mats that are effective in cushioning users falling only a small distance. However, the prior art does not teach an inflatable mat that may be inflated via connection to another inflated structure, thereby providing cushioning against short drops, without requiring either a blower, or a bulky foam mat. The present invention teaches an inflatable landing pad that may be disposed next to an inflatable play structure for cushioning a person entering or exiting the inflatable play structure, which may be inflated via connection to the inflatable play structure, rather than requiring the use of a separate blower. The present invention fulfills these needs and provides further advantages as described in the following summary.

SUMMARY OF THE INVENTION

The present invention teaches certain benefits in construction and use which give rise to the objectives described below.

The present invention provides an inflatable landing pad for use adjacent an exit portion of an inflatable play structure. The inflatable landing pad is positioned to cushion the landing of a person entering or exiting the exit portion of the inflatable play structure. The inflatable landing pad comprises an air mattress capable of sustaining an air pressure, and the air mattress is separated into a plurality of sections by vented baffles. The inflatable landing pad further includes an air supply tube having a proximal end and a distal end, the proximal end being sealably attached to the air mattress around an aperture for directing air into the air mattress. The inflatable landing pad further includes a means for removably attaching the distal end of the air supply tube to the air supply port of the inflatable play structure so that air can flow from the inflatable play structure, through the air supply tube, and into the air mattress.

A primary objective of the present invention is to provide an inflatable landing pad having advantages not taught by the prior art.

Another objective is to provide an inflatable landing pad that is effective in cushioning a fall of a person using an inflatable play structure, so that they are not injured upon entering or exiting the structure.

A further objective is to provide an inflatable landing pad that may be deflated for storage and shipping, so that they take up less space, and weigh less, than existing foam pads.

A further objective is to provide an inflatable landing pad that may receive air from an inflatable play structure, so that a separate blower is not required for inflating the inflatable landing pad.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, an inflatable landing pad for use adjacent an exit portion of an inflatable play structure. The inflatable landing pad functions to cushion the landing of a person entering or exiting the exit portion of the inflatable play structure. The inflatable landing pad is adapted to receive air from the inflatable play structure, so that an additional blower is not required to inflate the inflatable landing pad.

Figure 1:
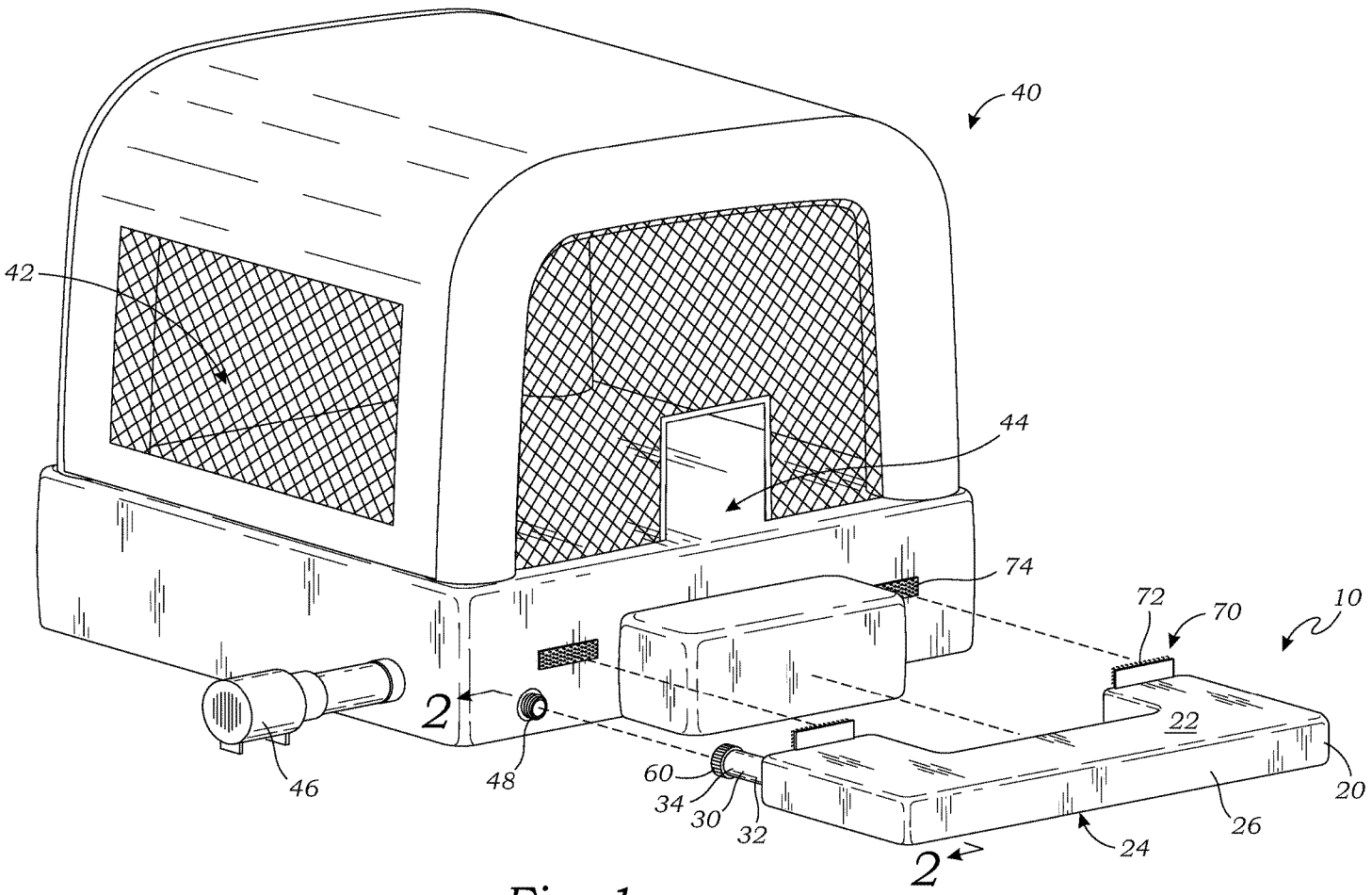
FIG. 1 is an exploded perspective view of a first embodiment of an inflatable landing pad adjacent an inflatable play structure having an air supply port.
Figure 2:
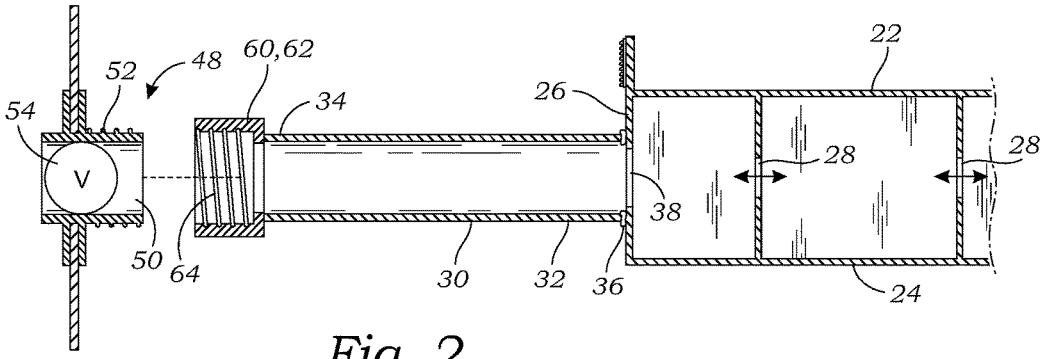
FIG. 2 is a sectional view of the inflatable landing pad and the air supply port of the inflatable play structure, taken along line 2-2 in FIG. 1.

FIG. 1 is an exploded perspective view of a first embodiment of an inflatable landing pad 10 adjacent an inflatable play structure 40 having an air supply port 48. FIG. 2 is a sectional view of the inflatable landing pad 10 and the air supply port 48 of the inflatable play structure 40, taken along line 2-2 in FIG. 1. As shown in FIGS. 1 and 2, the inflatable landing pad 10 includes an air mattress 20 capable of sustaining an air pressure, the air mattress 20 being separated into a plurality of sections by vented baffles 28.

Figure 3:
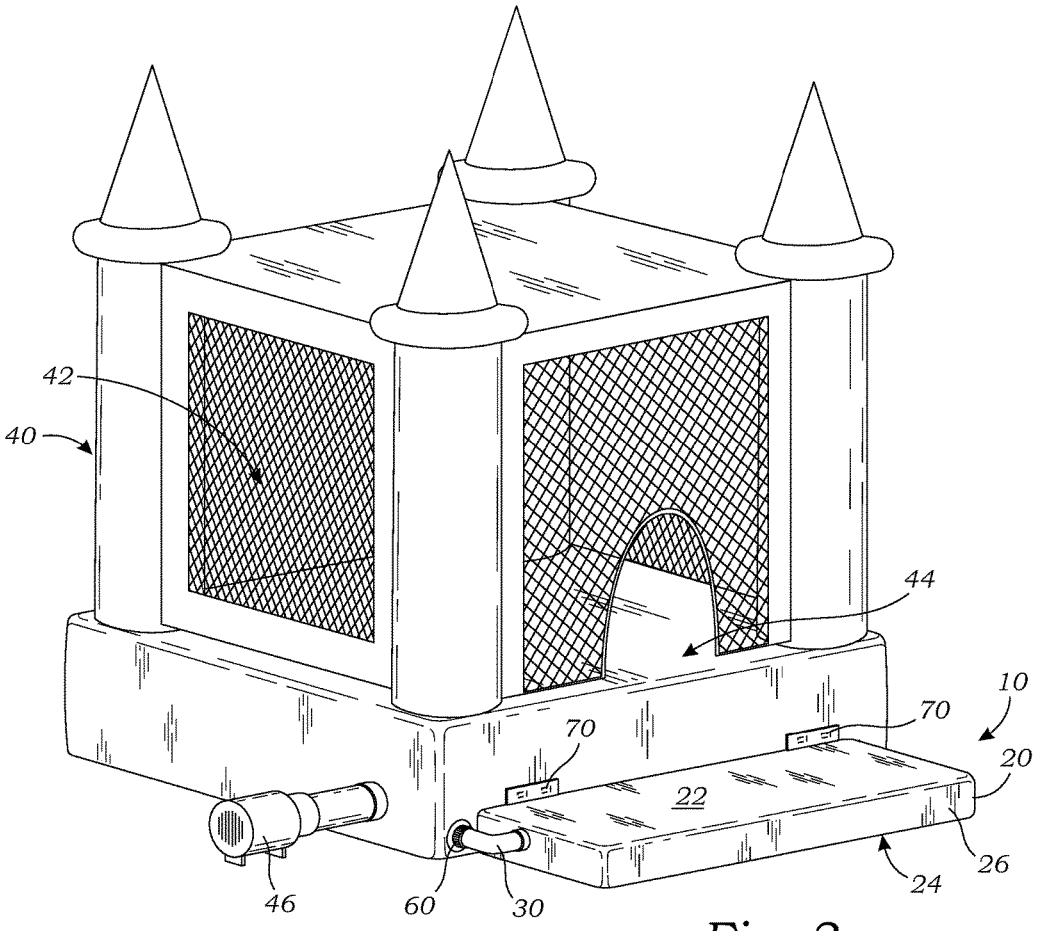
FIG. 3 is a perspective view of a second embodiment of the inflatable landing pad, adjacent a second embodiment of the inflatable play structure.

As shown in FIGS. 1 and 2, the air mattress 20 includes a top sheet 22, and an opposed bottom sheet 24, connected via a perimeter wall 26, to which may form a three dimensional structure that is suitable for protecting users from falls (e.g., rectangular prism, cuboid structure, etc.). In the embodiment of FIG. 1, the air mattress 20 forms a generally U-shaped structure shaped to fit around an exit platform of the inflatable play structure 40. In the embodiment of FIG. 3, the air mattress 20 is illustrated as a rectangular prism. In alternative embodiments, other shapes may be used, so long as they function to cushion a fall of a person using the inflatable play structure 40. The air mattress 20 is sized and shaped to be positioned adjacent and beneath the exit portion 44 of the inflatable play structure 40 so that persons exiting the exit portion 44 of the inflatable play structure 40 land upon the air mattress 20 and are cushioned. In this embodiment, the air mattress 20 has a thickness of 2-12 inches, preferably about 4 inches; however, this may vary depending upon the application, according to the requirements developed by one skilled in the art.

The inflatable landing pad 10 includes an air supply tube 30 that enables the inflatable landing pad 10 to receive air from the inflatable play structure 40, to inflate the inflatable landing pad 10 without requiring the use of an additional blower. The air supply tube 30 has a proximal end 32 and a distal end 34, and is typically a flexible, generally cylindrical structure, commonly constructed of a suitable flexible material such as polyvinyl chloride (PVC), textile-reinforced urethane plastic or rubber, or other suitable material known in the art. In alternative embodiments, the air supply tube 30 may be constructed of a rigid plastic, or other material desired by one skilled in the art. The proximal end 32 is sealably attached to the air mattress 20 (e.g., via a sealed seam 36), which extends around an aperture 38 for directing air into the air mattress 20. In alternative embodiments, the air supply tube 30 may be attached to the air mattress 20 in any manner known in the art (e.g., sewn, welded, etc.).

As shown in FIG. 1, the inflatable play structure 40 may be any form of inflatable structure known in the art (e.g., bouncy house, inflatable slide, climbing wall, etc.), and includes a play portion 42, an exit portion 44, an air supply blower 46, and an air supply port 48 adjacent the exit portion 44. The play portion 42 may be the portion of the inflatable play structure 40 upon which the users typically play (jumping area, slide surface, or other area where users typically climb, play, bounce, etc. The exit portion 44 is the area from which the users typically enter or exit the inflatable play structure 40, such as an exit gate, bottom of slide, or any other area where users typically exit the inflatable play structure 40, although the landing pad 10 may be used anywhere that its protection may be desired.

As shown in FIGS. 1 and 2, the air supply port 48 is a structure built into a wall of the inflatable play structure 40 that enables the air supply tube 30 to be attached to the inflatable play structure 40 for receiving air from the inflatable play structure 40. The inflatable landing pad 10 and the inflatable play structure 40 together include a means for removably attaching 60 the distal end 34 of the air supply tube 30 to the air supply port 48 of the inflatable play structure 40 so that air can flow from the inflatable play structure 40, through the air supply tube 30, and into the air mattress 20.

In the embodiment of FIGS. 1 and 2, the means for removably attaching 60 is in the form of a coupling attaching the distal end 34 of the air supply tube 30 for removably attaching the air supply tube 30 to the air supply port 48. In this embodiment, the coupling 60 includes a rigid annular housing 62 operably mounted in the distal end 34 of the air supply tube 30, and the rigid annular housing 62 is adapted to engage a receiver 50 operably mounted in the air supply port 48. The receiver 50 may include a valve 54 or similar mechanism that opens when the rigid annular housing 62 is engaged with the receiver 50, or when otherwise opened, to enable the inflatable play structure 40 to supply air to the inflatable landing pad 10, but to not otherwise leak air when the inflatable landing pad 10 is not being used.

As shown in FIGS. 1 and 2, in this embodiment the coupling 60 includes a internally threaded surface 64, and the receiver 50 includes an externally threaded surface 52, so that the coupling may be threadedly engaged with the receiver 50. Obviously, this relationship may be reversed, and the terms used in this application are hereby defined to include this reversed construction within the scope of the following claims. Furthermore, while a threaded engagement is shown, the invention is further anticipated to include alternative coupling mechanisms, such as locking posts/slots, frictional fits, and other engagement mechanisms known in the art.

The coupling and the receiver 50 are preferably selected to enable a removable connection that enables them to be connected and disconnected quickly and easily, preferably without the use of tools, and preferably with less than 5 seconds of work to make the connection or disconnection.

The inflatable landing pad 10 further includes a means for removably engaging 70 the inflatable landing pad 10 with the inflatable play structure 40 adjacent the exit portion 44. In this embodiment, the means for removably engaging 70 the inflatable landing pad 10 with the inflatable play structure 40 includes a first fastener 72 of the inflatable landing pad 10 which removably engages a second fastener 74 of the inflatable play structure 40. In the embodiment of FIG. 1, the first and second fasteners 72 and 74 comprise hooks and loops fasteners. In the embodiment of FIG. 3, the first and second fasteners 72 and 74 comprise snaps. In alternative embodiments, the first and second fasteners 72 and 74 may comprise alternative fastening mechanisms known in the art, and such alternatives should be considered within the scope of the present invention, as claimed below.

FIG. 3 is a perspective view of a second embodiment of the inflatable landing pad 10, adjacent a second embodiment of the inflatable play structure 40. As shown in FIG. 3, the inflatable play structure 40 may be any form of inflatable structure or device known in the art, from which a user may need to exit (and from which he or she may potentially fall).

The inflatable landing pad 10 may be constructed using different shapes and sizes to provide the necessary cushion.

In the embodiment of FIG. 3, the first and second fasteners 72 and 74 comprise snaps, which may be used to removably fasten the inflatable landing pad 10 with the inflatable play structure 40. While this is not required, it may be helpful in some embodiments to keep the inflatable landing pad 10 in a correct position relative to the inflatable play structure 40.

Figure 4:
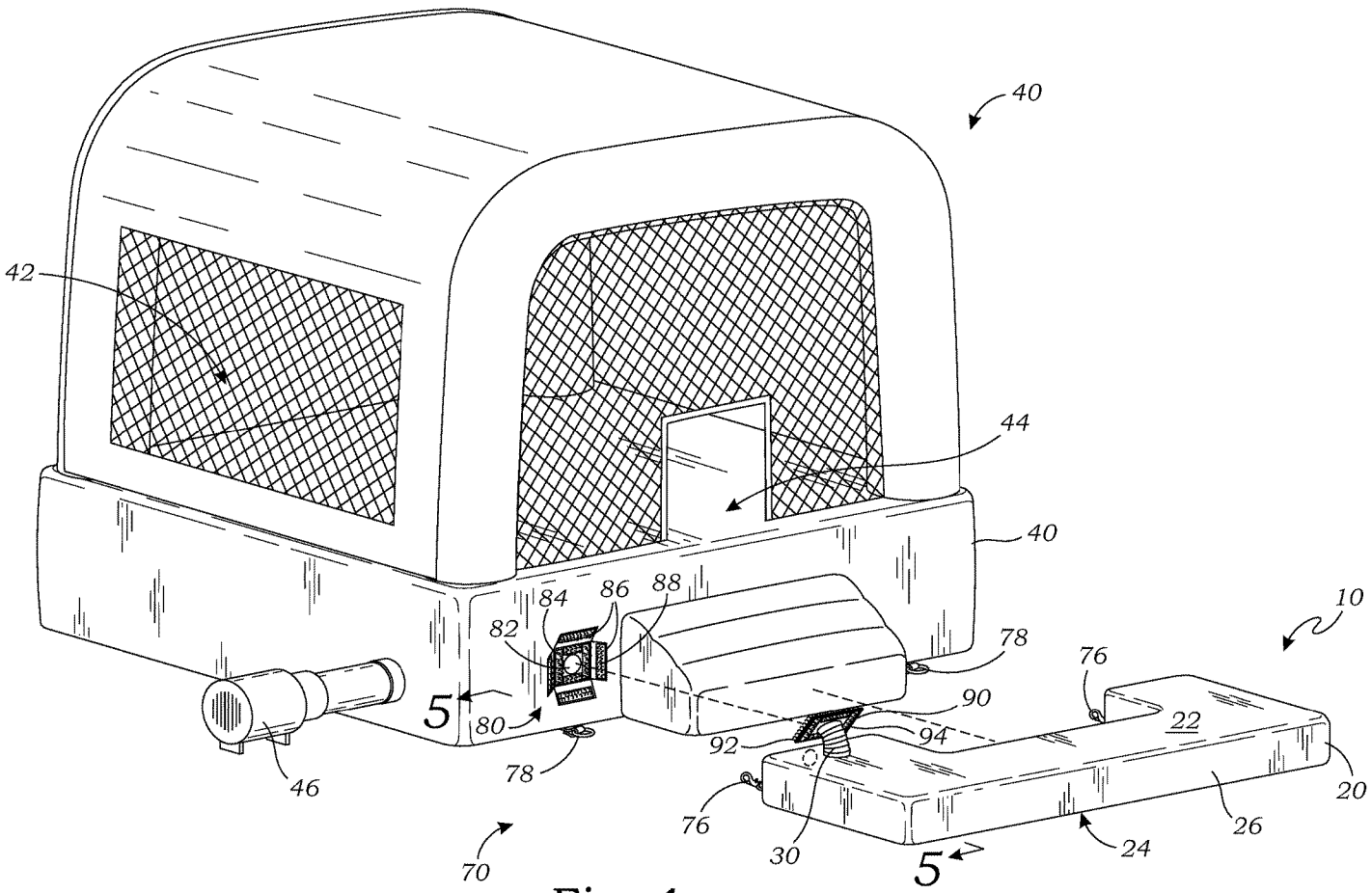
FIG. 4 is an exploded perspective view of a third embodiment of an inflatable landing pad adjacent a third embodiment of the inflatable play structure having an alternative embodiment of the air supply port.
Figure 5:
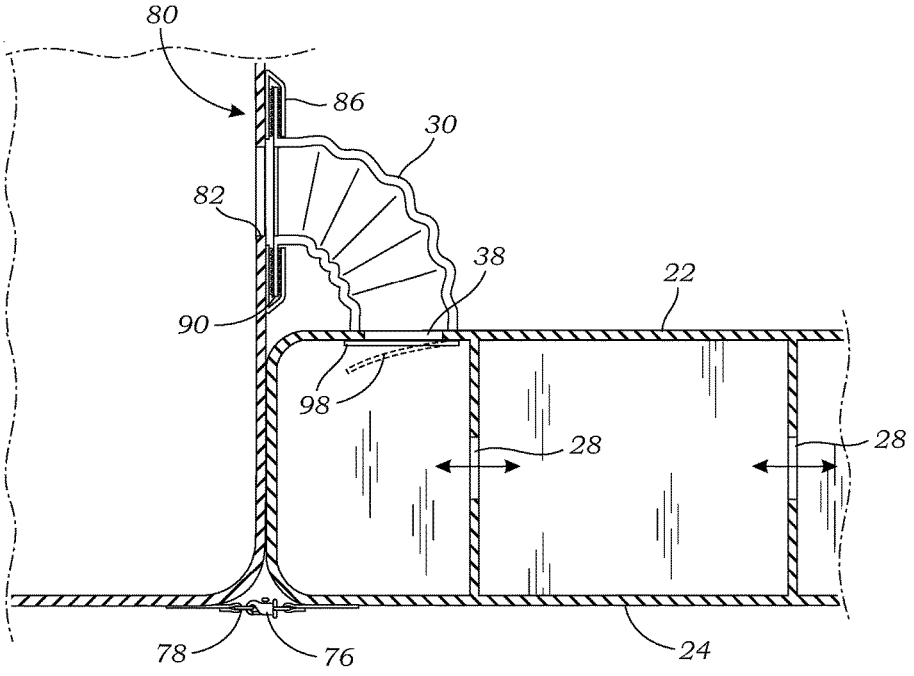
FIG. 5 is a sectional view of the inflatable landing pad and the air supply port of the inflatable play structure, taken along line 5-5 in FIG. 4.

FIG. 4 is an exploded perspective view of a third embodiment of an inflatable landing pad adjacent a third embodiment of the inflatable play structure having an alternative embodiment of the air supply port. FIG. 5 is a sectional view of the inflatable landing pad and the air supply port of the inflatable play structure, taken along line 5-5 in FIG. 4. As shown in FIGS. 4-5, in this embodiment, the first and second fasteners include rings 76 and 78 that either engage each other, or which may be tied together with another fastener (not shown). For purposes of this application, the term "ring" is hereby defined to include any form of ring or ring like structure, including hooks, clips, carabiners, or similar structures which may be readily connected together for removably fastening the inflatable landing pad 10 to the inflatable play structure 40.

In the embodiment of FIGS. 4-5, the air supply port 80 of the inflatable play structure 40 includes an air supply hole 82 surrounded around its perimeter with a first fastener 84 (all fasteners may be selected from any suitable removable fastener known in the art, e.g., hooks and loops, etc.), and may further include flaps 86 that include second fasteners 88 (also, in this case, hooks and loops fasteners). In this embodiment, the means for removably attaching the distal end of the air supply tube 30 to the air supply port 80 includes a flange 90 extending radially from the circumference of the distal end 34, the flange 90 having a third fastener 92 on one side, and a fourth fastener 94 on the opposing side.

Using this construction, flange 90 is fastened to the play structure 40 by attaching the first fastener 84 with the third fastener 92 so that the air supply tube 30 is operably connected with the air supply hole 82. The flaps 86 may then be used to cover the flange 90 such that the second fasteners 88 and the fourth fasteners 94 are engaged. An advantage of this construction is that no rigid parts are required, and the connection may be quickly and easily either engaged or disengaged, during set up or take down of the play structure 40.

As shown in FIG. 5, in this embodiment, a flap 90 is operably installed in the top sheet 22 of the air mattress to cover the inlet of the air supply tube 30 (although the flap may be located in other suitable locations). The flap 90 allows air to flow into the air mattress 20 when it is deflated, to properly pressurize it, but then prevent back-flow when the air mattress 20 is impacted by a user, thereby cushioning the fall.

Method of Use.

The above described embodiments of the invention, and alternative embodiments that may be devised by one skilled in the art, enable a novel method for protecting a person from a falling injury when exiting an inflatable play structure 40. The method comprises the steps of first providing the inflatable play structure 40 and the inflatable landing pad 10 described above, and then positioning the air mattress 20 adjacent and beneath the exit portion 44 of the inflatable play structure 40 so that persons exiting the exit portion 44 of the inflatable play structure 40 land upon the air mattress 20. The inflatable landing pad 10 may be removably attached to the inflatable play structure 40, as discussed above, to maintain the inflatable landing pad 10 in a correct location relative to the inflatable play structure 40, although this is not required.

The distal end 34 of the air supply tube 30 is then attached to the air supply port 48 of the inflatable play structure 40 so that air can flows from the inflatable play structure 40, through the air supply tube 30, and into the air mattress 20. Depending upon the valve 54 used, the valve 54 may need to be manually opened, unless the valve 54 is opened automatically by the attachment of the coupling with the receiver 50.

Following use, the inflatable landing pad 10 may be detached from the inflatable play structure 40, and allowed to deflate, for efficient storage and shipping. The smaller deflated size, and reduced weight, provide a significant advantage over heavy and bulky foam pads such as are used in the prior art, which require more significant space for storage and shipping, and which are heavier to move for storage and setup.

As used in this application, the words "a," "an," and "one" are defined to include one or more of the referenced item unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by the following claims.

What is claimed is:

1. An inflatable landing pad for use adjacent an exit portion of an inflatable play structure having an air supply port, the inflatable landing pad functioning to cushion the landing of a person entering or exiting the exit portion of the inflatable play structure, the inflatable landing pad comprising:

an air mattress capable of sustaining an air pressure, the air mattress being separated into a plurality of sections by vented baffles, the air mattress being sized and shaped to be positioned adjacent and beneath the exit portion of the inflatable play structure so that persons entering or exiting the exit portion of the inflatable play structure land upon the air mattress;

an air supply tube having a proximal end and a distal end, the proximal end being sealably attached to the air mattress around an aperture for directing air into the air mattress;

a means for removably attaching the distal end of the air supply tube to the air supply port of the inflatable play structure so that air can flow from the inflatable play structure, through the air supply tube, and into the air mattress; and wherein the inflatable landing pad does not include a blower, and receives air only from the inflatable play structure.

2. The inflatable landing pad of claim 1, wherein the means for removably attaching includes an annular housing operably mounted in the distal end of the air supply tube, the annular housing being adapted to removably engage the air supply port.

3. The inflatable landing pad of claim 1, wherein the means for removably attaching includes the air supply port in the inflatable play structure, and a first fastener disposed around the air supply port; and further includes a flange formed in the distal end of the air supply tube, and a second fastener disposed on the flange for removably attaching the flange to the inflatable play structure such that the air supply tube is operably connected to the air supply port for receiving air from the inflatable play structure.

4. The inflatable landing pad of claim 3, wherein the means for removably attaching further includes flaps having a third fastener, and the flange includes a fourth fastener opposite the second fastener, such that the flaps may be secured over the flange via the third and fourth fasteners for further securing the flange in place on the inflatable play structure.

5. A combination structure and landing pad comprising:

an inflatable play structure having a play portion, an exit portion, an air supply blower, and an air supply port;

an inflatable landing pad comprising an air mattress capable of sustaining an air pressure, the air mattress being separated into a plurality of sections by vented baffles, the air mattress being sized and shaped to be positioned adjacent and beneath the exit portion of the inflatable play structure so that persons entering or exiting the exit portion of the inflatable play structure land upon the air mattress;

an air supply tube having a proximal end and a distal end, the proximal end being sealably attached to the air mattress around an aperture for directing air into the air mattress;

a coupling attaching the distal end of the air supply tube for removably attaching the air supply tube to the air supply port of the inflatable play structure so that air can flow from the inflatable play structure, through the air supply tube, and into the air mattress.

6. The combination of claim 5, wherein the coupling includes an annular housing operably mounted in the distal end of the air supply tube, the rigid annular housing being adapted to engage a receiver operably mounted in the air supply port, the receiver comprising a valve that opens when the rigid annular housing is engaged with the receiver.

7. The combination of claim 5, further comprising a means for removably engaging the inflatable landing pad with the inflatable play structure adjacent the exit portion.

8. The combination of claim 5, wherein the means for removably engaging the inflatable landing pad with the inflatable play structure includes a first fastener of the inflatable landing pad which removably engages a second fastener of the inflatable play structure.

9. The combination of claim 5, wherein the inflatable landing pad does not include a blower, and receives air only from the inflatable play structure.

10. The combination of claim 5, wherein the coupling includes the air supply port in the inflatable play structure, and a first fastener disposed around the air supply port; and further includes a flange formed in the distal end of the air supply tube, and a second fastener disposed on the flange for removably attaching the flange to the inflatable play structure such that the aft supply tube is operably connected to the air supply port for receiving air from the inflatable play structure.

11. The combination of claim 10, wherein the coupling further includes flaps having a third fastener, and the flange includes a fourth fastener opposite the second fastener, such that the flaps may be secured over the flange via the third and fourth fasteners for further securing the flange in place on the inflatable play structure.

12. A method for protecting a person from a falling injury when entering or exiting an inflatable play structure, the method comprising the steps of:

providing an inflatable play structure having a play portion, an exit portion, an air supply blower, and an air supply port;

providing an inflatable landing pad comprising an air mattress capable of sustaining an air pressure, the air mattress being separated into a plurality of sections by vented baffles, and further comprising an air supply tube having a proximal end and a distal end, the proximal end being sealably attached to the air mattress around an aperture for directing air into the air mattress;

positioning the air mattress adjacent and beneath the exit portion of the inflatable play structure so that persons entering or exiting the exit portion of the inflatable play structure land upon the air mattress; and attaching the distal end of the air supply tube to the air supply port of the inflatable play structure so that air can flows from the inflatable play structure, through the air supply tube, and into the air mattress.

* * * * *